US005196812A

United States Patent [19]

Drost et al.

[11] Patent Number: 5,196,812

[45] Date of Patent: Mar. 23, 1993

[54] COMPACT N-WAY WAVEGUIDE POWER DIVIDER

[75] Inventors: Steven W. Drost, Redondo Beach; William W. Milroy, Playa del Rey, both of Calif.

[73] Assignee: Hughes Aircraft Company, Los Angeles, Calif.

[21] Appl. No.: 722,727

[22] Filed: Jun. 27, 1991

[51] Int. Cl.[5] ..... H01P 5/18

[52] U.S. Cl. ..... 333/113; 333/137

[58] Field of Search ..... 333/113, 125, 137; 343/771, 776–779

[56] References Cited

U.S. PATENT DOCUMENTS

| | | | |
|---|---|---|---|
| 2,585,173 | 2/1952 | Riblet | 333/113 |
| 2,779,001 | 1/1957 | Records | 333/113 |
| 3,045,238 | 7/1962 | Cheston | 343/776 |
| 3,230,483 | 1/1966 | Kinsey | 343/771 X |
| 4,520,329 | 5/1985 | D'Oro et al. | 333/113 X |

FOREIGN PATENT DOCUMENTS

| | | | |
|---|---|---|---|
| 133384 | 12/1978 | Fed. Rep. of Germany | 333/113 |

*Primary Examiner*—Paul Gensler

*Attorney, Agent, or Firm*—L. A. Alkov; W. K. Denson-Low

[57] ABSTRACT

An n-way waveguide power divider wherein microwave power entering a first waveguide section is directionally coupled simultaneously into a plurality of parallel waveguide sections that share a longitudinal portion of their broad walls with a different longitudinal portion of the broad walls of the first waveguide section. The power is coupled through an individual pair of elongated axially-aligned coupling members in each of the shared broad wall longitudinal portions. The coupling members may have a variety of shapes including square, rectangular, circular, cross, or dog bone shapes.

11 Claims, 6 Drawing Sheets

FIG. 1.
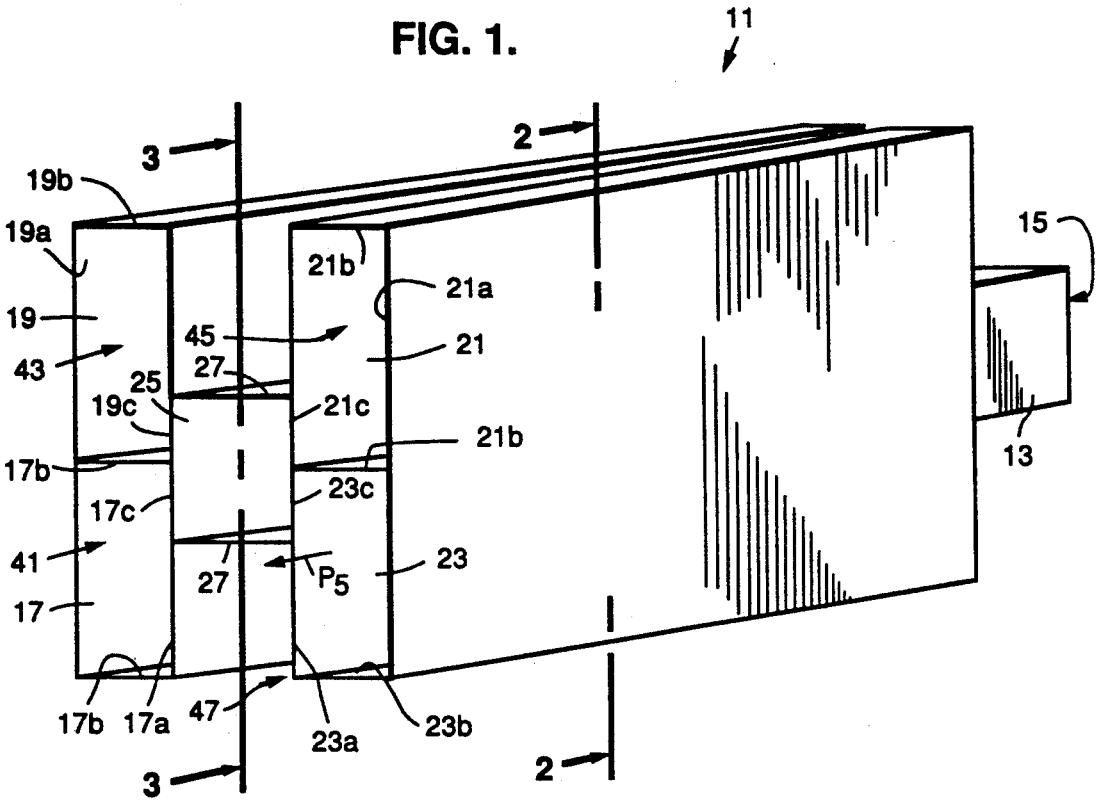
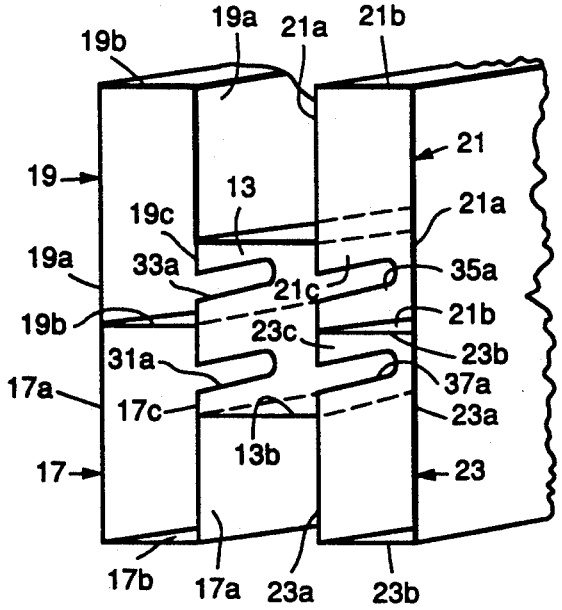
FIG. 2.

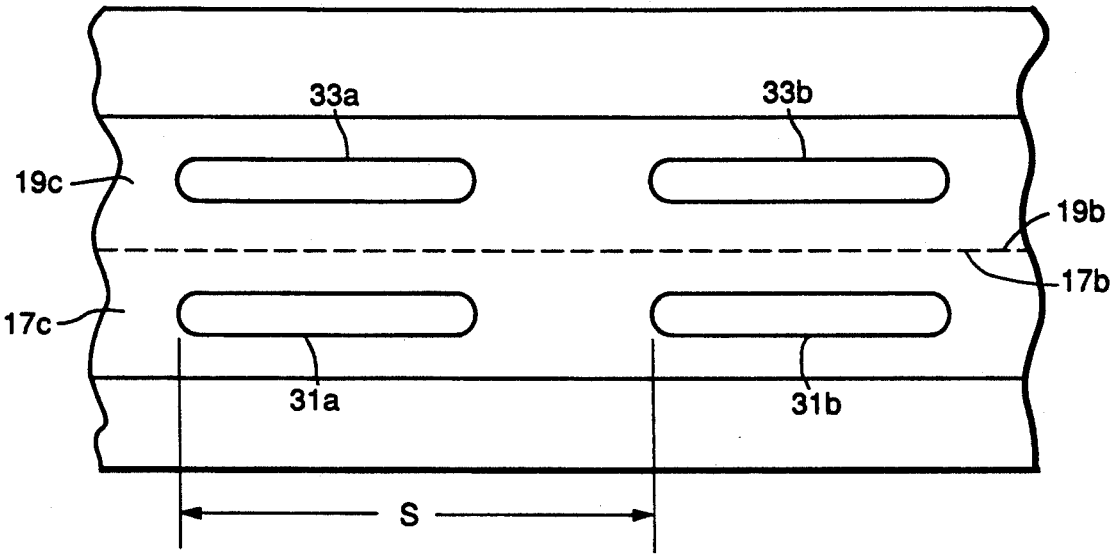
FIG. 3.
FIG. 4.
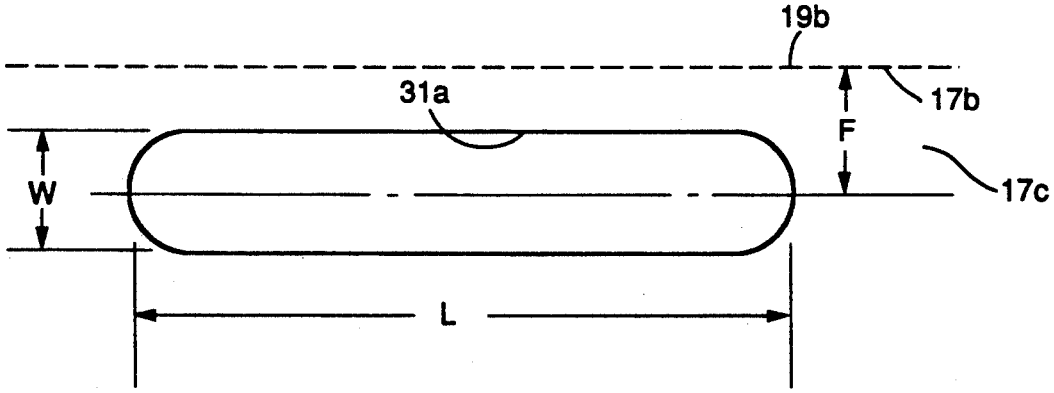

FIG. 7b.
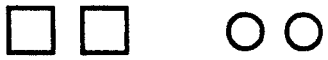
FIG. 7a.
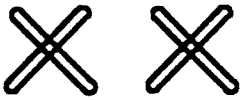
FIG. 7c.
FIG. 7d.
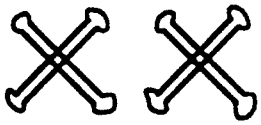
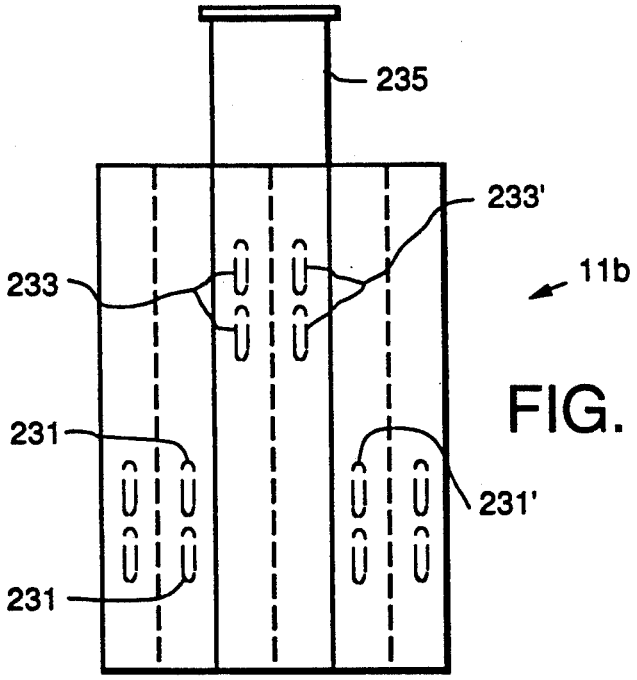
FIG. 9a.
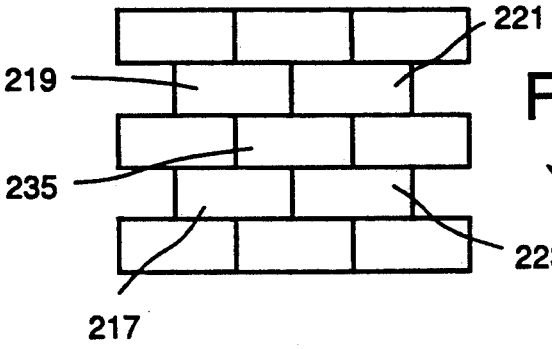
FIG. 9b.

11a
11a
153'
121'
115
113
119
153
133
131
153'
121'
119
153
113
151'
123
115
117
155
151

COMPACT N-WAY WAVEGUIDE POWER DIVIDER

BACKGROUND

The present invention relates generally to microwave waveguide structures, and more particularly, to waveguide power dividers.

Directional couplers that incorporate two waveguide structures are well known in the art. For many years, directional couplers have been designed and papers written describing what are known as 2-way power dividers that are constructed using two adjacent waveguides, the power entering one of the waveguides and being coupled through a coupling slot arrangement to the adjacent waveguide from which power is output in a desired direction. For example, such a device is described in a paper by M. Surdin, entitled "Direction Couplers in Wave Guides", Journal IEEE, Vol 93, pt. IIIA, 1946, p. 725. Also, reference may be made to an article by Dennis C. Cooper, entitled "Waveguide Directional Couplers using Inclined Slots", in *Microwave Journal,* August, 1966.

There are many applications in the microwave art where multiple directional couplers, ganged together, are required to accomplish a task. For example, microwave antenna feeding systems and subsystems may require multiple power dividers, and the need to keep the weight and dimensions of these devices as small as possible is very important.

In the past, the only way to provide such a structure required the coupling together of multiple conventional 2-way power dividers, each consisting of two waveguides. This solution is both bulky and heavy. In applications where the minimization of space required to fabricate such a power divider is an important factor, such a structure could not be used.

The present invention has the advantage of using the minimum absolute space necessary for a power divider using more than 2 waveguides. This is accomplished using a novel and compact coupling scheme. Thus, it should be recognized that a technique which reduces the weight and space required for a multiple microwave power divider would constitute an important advancement in the art.

SUMMARY OF THE INVENTION

In view of the foregoing factors and conditions characteristic of the prior art, it is a primary objective of the present invention to provide a new and improved compact n-way power divider. Another objective of the present invention is to provide a lighter-weight and less bulky n-way power divider. Still another objective of the present invention is to provide a compact n-way power divider used in building microwave antenna arrays. Yet another objective of the present invention is to provide an n-way power divider that utilizes a novel and compact coupling technique.

In accordance with an embodiment of the present invention, a compact n-way power divider includes a first waveguide section having a power input port, a pair of opposite broad walls and a pair of opposite narrow walls. Also included is a plurality of parallel waveguide sections, each being parallel to the first waveguide section and each having a pair of opposite broad walls and narrow walls, a longitudinal portion of each of the plurality of waveguide sections being juxtaposed a different longitudinal portion of the first waveguide section, defining common wall portions thereof. The invention also includes coupling means having a pair of coupling members, which may be relatively narrow and elongated slots having a square or rectangular cross section, or may comprise circular or ellipsoidal holes, or may comprise openings in the shape of crosses or dog bones, for example, disposed in each of the common wall portions for directionally coupling power entering the first waveguide section into each of the plurality of waveguide sections.

According to a presently preferred embodiment of the invention, a 5-way waveguide power divider comprises a first waveguide section and two pairs of parallel waveguide sections, each pair sharing a common narrow wall, and a longitudinal portion of each of the broad walls of these waveguide sections sharing a longitudinal portion of a broad wall of the first waveguide section.

Thus, the present invention provides for a new approach for a compact antenna feed using a novel coupling scheme. By using this compact directive coupling scheme, an antenna feeding system or subsystem may be built with minimal space requirements.

Any device which reduces weight and space in antenna feeding systems, such as this invention, is of significant importance to improving the state of the art.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a perspective view of a compact n-way power divider constructed in accordance with the present invention;

FIG. 2 is a partial section taken along line 2—2 of FIG. 1, in perspective;

FIG. 3 is a side elevational view of a sectional portion of the n-way power divider of FIG. 1, taken along line 3—3;

FIG. 4 is an enlarged view of one of the elongated slots shown in FIG. 3;

Figure 5A:
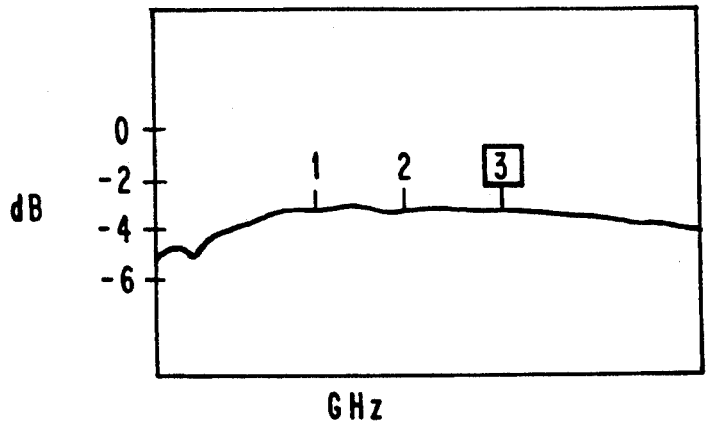
Figure 5B:
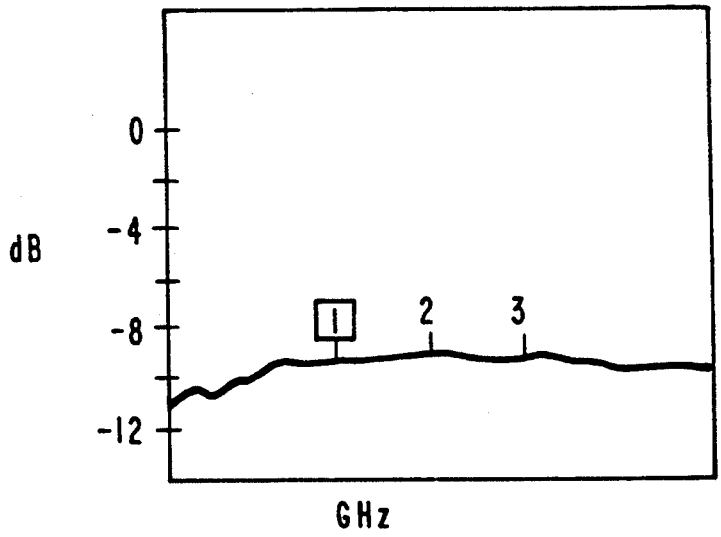
Figure 5C:
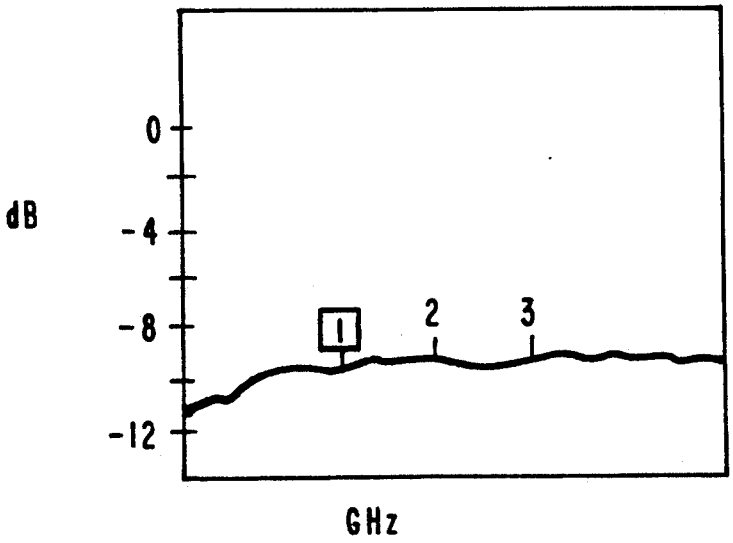
Figure 5D:
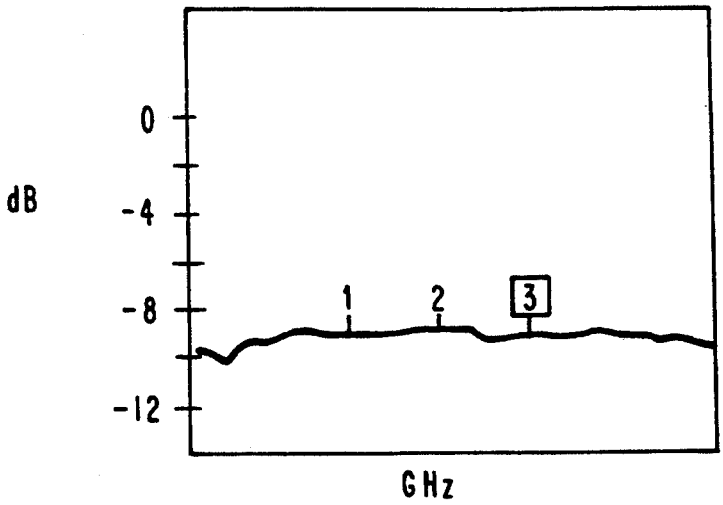
Figure 5E:
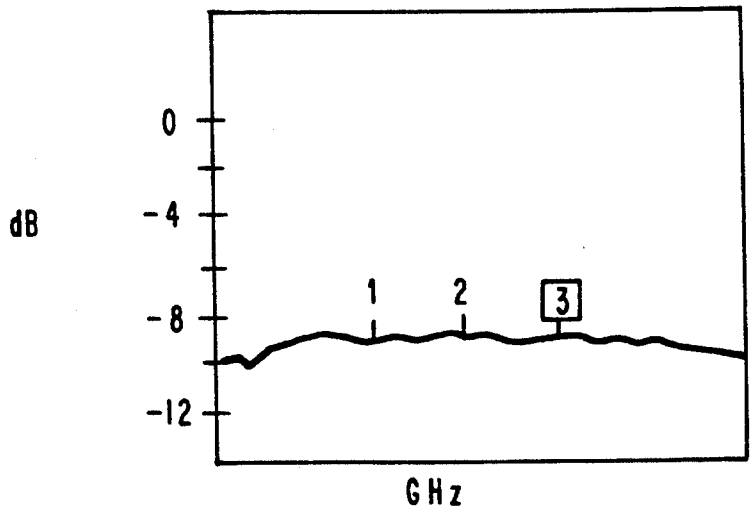
Figure 6:
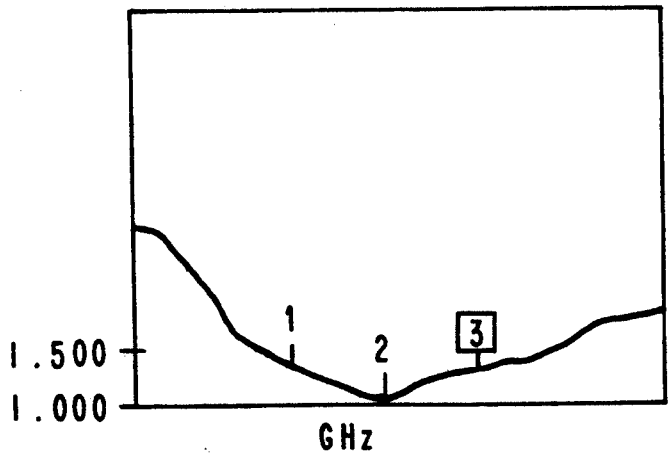

FIGS. *5a–5e* are a graphical representation of the output power from each of the ports of the power divider of FIG. 1 with respect to frequency, using the data from Table I;

FIG. 6 is a graphical representation of the input power of the power divider of FIG. 1 as against the standing wave ratio as seen at the input port, using the data from Table II;

FIGS. *7a–7d* illustrate a variety of shapes for the coupling slots of the power divider of FIG. 1; and FIGS. *8a, 8b* and *9a, 9b* illustrate a more complete view of an n-way power divider in accordance with the principles of the present invention.

DETAILED DESCRIPTION

Referring now to the drawings, and more particularly to FIGS. 1 and 2, there is shown a compact 5-way waveguide power divider 11 having a first waveguide section 13 with a power input port 15, and second, third, fourth and fifth waveguide sections, identified respectively by reference numerals 17, 19, 21 and 23.

The first waveguide section 13 has opposite broad walls 25 and opposite narrow walls 27. Likewise, each of the other four parallel waveguide sections have opposite broad walls (a) and narrow walls (b). As can be seen in the figures, a longitudinal portion (c) of each of the four waveguide sections 17, 19, 21 and 23 are juxtaposed and thus share a common wall with a different longitudinal portion (a, b, c and d) of the broad walls 25 of the first waveguide section 13.

Directional coupling from the first waveguide section 13 to the four adjacent waveguide sections is provided by individual pairs of relatively narrow elongated coupling members, or slots 31*a* and 31*b*, 33*a* and 33*b*, 35*a* and 35*b*, and 37*a* and 37*b*, each pair being disposed in a different one of the longitudinal common wall portions of the waveguides, namely 17*c*, 19*c*, 21*c* and 23*c* (see FIGS. 2 and 4). And, the power thus coupled through the slots, appears as output powers at respective output ports 41, 43, 45 and 47.

The length of each slot is denoted by the letter L, the width by the letter W, the separation by the letter S, and each slot is offset from the center common walls, 17*b*, 19*b* and 21*b*, 23*b* by a distance denoted by the letter F. It has been found that if the offsets F, the lengths L, and the separations S of the slots are the same for all the waveguides, because of symmetry, the coupled guides 17–23 will have the same power coupled to each guide from the first waveguide 13. The dimensions of the coupling slots, the separation and the offset distance may be calculated in accordance with principles well known in the waveguide art, and/or based on empirical data.

Although the coupling slots described herein all have the same parameters (offsets F, lengths L, and separations S) for each the waveguides, resulting in equal power being coupled to all the coupled waveguides, this in general need not be not true. The offsets F, lengths L, and separations S may be varied independently in each waveguide to independently control the power coupled to each waveguide, if desired.

In a 5-way power divider constructed in accordance with the present invention, the power output from the four output ports 41, 43, 45 and 47 was measured. Table I provides tabular data of the output powers at frequencies $f_1$, $f_2$, and $f_3$, and FIGS. 5A–5E graphically illustrates the power present at the input port 15 and the four output ports 41–47 for these three frequencies.

TABLE I

| | $f_1$ | $f_2$ | $f_3$ |
|---|---|---|---|
| Input port 15 | −3.3 | −3.3 | −3.4 |
| Output port 41 | −9.6 | −9.4 | −9.2 |
| Output port 43 | −9.7 | −9.5 | −9.2 |
| Output port 45 | −9.1 | −9.0 | −8.9 |
| Output port 47 | −9.1 | −9.0 | −9.0 |

It has also been found that the 5-way power divider has a relatively low input SWR because of its directive properties. Table II provides the data, and the graph of FIG. 6 shows the relationship of inputs SWR and frequency for the three above-noted frequencies.

TABLE II

| | $f_1$ | $f_2$ | $f_3$ |
|---|---|---|---|
| Input SWR | 1.38 | 1.05 | 1.28 |

FIGS. 7*a*–7*d* illustrate a variety of well-known conventional shapes for the coupling slots of the power divider 11 of FIG. 1. FIG. 7*a* shows square or rectangular cross sectional shapes of the coupling slots 31, 33, 35, 37. FIG. 7*b* shows circular shapes of the coupling slots 31, 33, 35, 37. FIG. 7*b* shows cross shapes of the coupling slots 31, 33, 35, 37. FIG. 7*b* shows dog bone shapes of the coupling slots 31, 33, 35, 37.

Figures 8A, 8B:
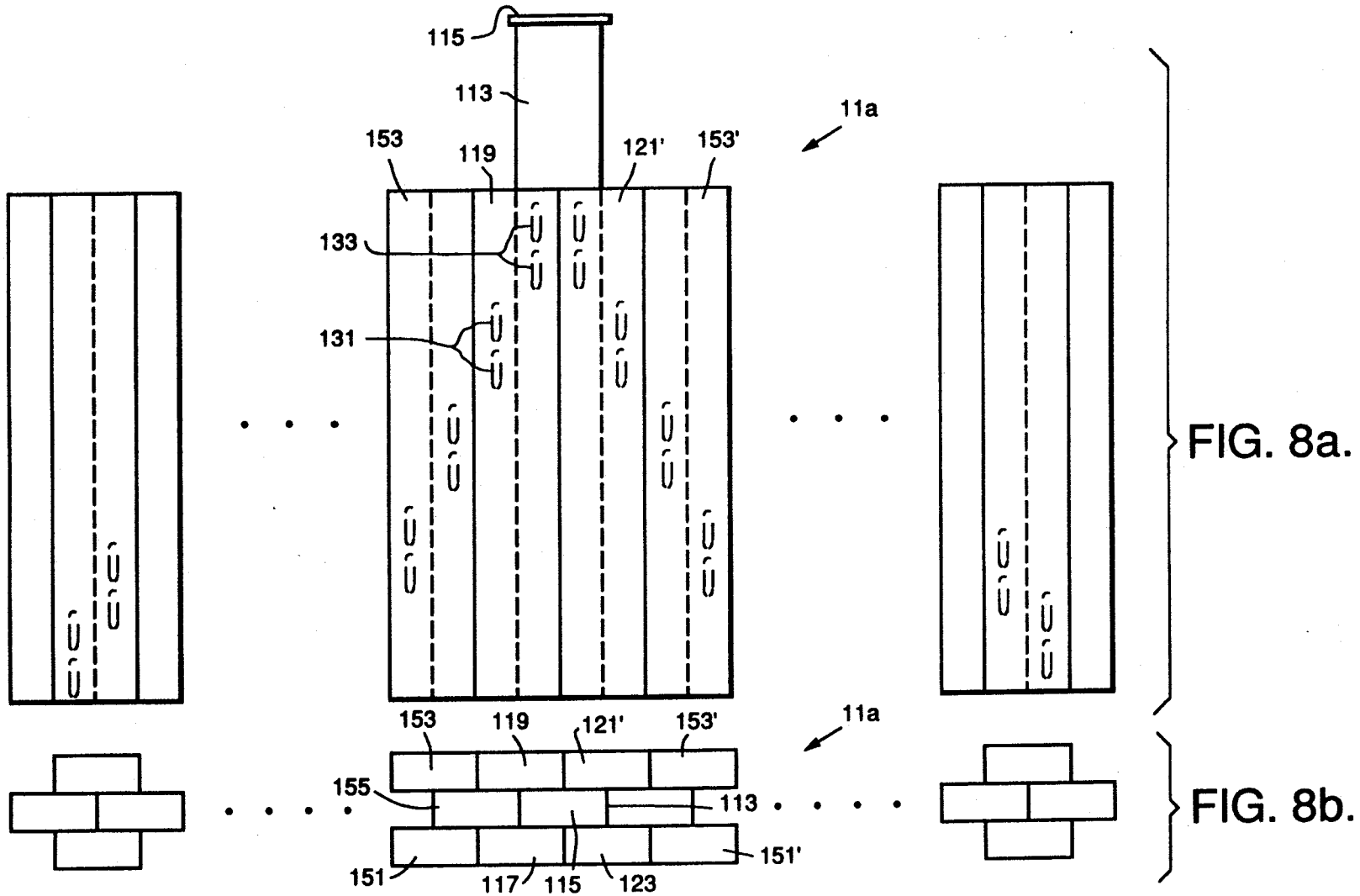

FIGS. 8*a* and 8*b* illustrate top and side views of an n-way power divider 11*a* in accordance with the principles of the present invention. The cross sectional pattern shown in the 5-way divider 11 of FIG. 1 is replicated for the n-way divider 11*a* of FIGS. 8*a* and 8*b*. For example, these figures show that this embodiment of the invention includes a first waveguide section 113 and a power input port 115. Disposed immediately adjacent the first waveguide section 113 are four waveguide sections 117, 119, 121, and 123. Similar to the previously described embodiment, coupling member pairs 131, 133 are located in the common walls, allowing energy to be coupled from the input waveguide sections 113 to the four surrounding waveguide sections.

Extending this technique, additional outer waveguide sections 151 and 153 in conjunction with waveguide sections 119 and 117, are disposed about a central waveguide section 155 which lies immediately adjacent the input waveguide section 113. This configuration is mirrored on the opposite side of the input waveguide section 113, using waveguide sections 121', 123, 151', 153' and appropriate coupling members are disposed in common walls of all of these waveguide sections, following the same principles set forth with respect to the first described embodiment. Thus, a truly compact n-section waveguide power divider is provided in this embodiment.

Finally, FIG. 9*a* and 9*b* show top and side views of an n-way power divider 11*b* illustrating the relative locations of the slots and waveguide sections at the various levels of the power divider 11*b*. Like the power divider 11*a*, this embodiment utilizes coupling member pairs 231, 231', 233, 233' disposed in common walls of adjacent waveguide sections to provide the desired power division. However, unlike the extension of the additional waveguide sections as represented in FIG. 8 generally parallel to the width dimension of the input waveguide section (embodiment 11*a*), in this embodiment, the additional n-sections, 217, 219, 221, 233 generally extend from an input waveguide section 235 as shown in FIG. 9*b*.

Thus there has been described a new and improved N-way waveguide power divider. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A compact n-way waveguide power divider, comprising:

a first waveguide section having a power input port, a pair of opposite broad walls and a pair of opposite narrow walls;

a plurality of parallel waveguide sections, each being parallel to said first waveguide section and each having a pair of opposite broad walls and narrow walls, a longitudinal portion of each of said plurality of waveguide sections being juxtaposed a different longitudinal portion of said first waveguide section defining common wall portions thereof wherein said plurality of waveguide sections comprises four waveguide sections, wherein said four waveguide sections comprise two pairs of waveguide sections, each pair sharing a common narrow wall; and coupling means including a pair of relatively narrow coupling members disposed in each of said common wall portions for directionally coupling power entering said first waveguide section into each of said plurality of waveguide sections.

2. The compact n-way waveguide power divider according to claim 1, wherein said pair of coupling members comprise relatively narrow elongated coupling slots.

3. The compact n-way waveguide power divider according to claim 2, wherein said pair of coupling slots have a common axis and are separated by a predetermined distance.

4. The compact n-way waveguide power divider according to claim 3, wherein said coupling slots have predetermined width and offset dimensions.

5. The compact n-way waveguide power divider according to claim 4, wherein said offsets, lengths and separations of said slots are the same for each of said common wall portions.

6. The compact n-way waveguide power divider according to claim 4, wherein selected ones of said offsets, lengths and separations of said slots are varied for selected ones of said common wall portions, to vary the amount of power coupled to individual ones of the waveguide sections.

7. The compact n-way waveguide power divider according to claim 1, wherein each of said pairs of waveguide sections share a common wall with a different broad wall of said first waveguide section.

8. The compact n-way waveguide power divider according to claim 1, wherein said pair of coupling members comprise openings having circular shapes.

9. The compact n-way waveguide power divider according to claim 1, wherein said pair of coupling members comprise openings having cross shapes.

10. The compact n-way waveguide power divider according to claim 1, wherein said pair of coupling members comprise openings having dog bone shapes.

11. The compact n-way waveguide power divider according to claim 1, wherein said pair of coupling members comprise openings having rectangular shapes.

* * * * *